US005148855A

United States Patent [19]

Ashok

[11] Patent Number: 5,148,855

[45] Date of Patent: Sep. 22, 1992

[54] FEEDING SYSTEM FOR BELT CASTING OF MOLTEN METAL

[75] Inventor: Sankaranarayanan Ashok, Bethany, Conn.

[73] Assignee: Olin Corporation, Cheshire, Conn.

[21] Appl. No.: 576,863

[22] Filed: Sep. 4, 1990

[51] Int. Cl.[5] ..... B22D 11/06

[52] U.S. Cl. ..... 164/479; 164/429

[58] Field of Search ..... 164/423, 429, 463, 479

[56] References Cited

U.S. PATENT DOCUMENTS 4,958,678 9/1990 Kawamura et al. ..... 164/463

FOREIGN PATENT DOCUMENTS 242063 10/1962 Australia ..... 164/429
58-90357 5/1983 Japan ..... 164/479
59-50957 3/1984 Japan ..... 164/479

OTHER PUBLICATIONS

J. Herbertson et al, "Strip Casting Studies at BHP Central Research Laboratories", CCC'90 Fifth International Casting Conference, Voest Alpine, Industrieanlangenbau, Linz, Jun., 1990.

J. Kherbertson et al, "A Novel Concept for Metal Delivery to Thin Strip Casters Casting of Near Net Shaped Products", TMS-AIME, pp. 335-349.

J. Herbertson et al, "Fluid Dynamics in High-Speed Strip-Casting Metal Delivery System", International Conference on New Smelting Reduction of Near Net Shape Casting Technologies for Steel, SRNC-9, J. S. Truelove, pp. 1/10-11/10.

*Primary Examiner*—Kuang Y. Lin
*Attorney, Agent, or Firm*—Bruce E. Burdick

[57] ABSTRACT

A casting system for casting molten metal into a continuous solidified strip. A source of molten metal is fed onto a tundish which is interposed between the source of molten metal and a continuous substrate system preferably in the form of a continuous belt. The tundish directs the molten metal onto the moving belt in a direction toward the upstream end thereof so that it is moving in a direction opposed to the direction of the belt. This method of feeding the melt onto the belt results in less turbulance, a dampening of the molten metal and a spreading of the material across the width of the belt.

7 Claims, 1 Drawing Sheet

FEEDING SYSTEM FOR BELT CASTING OF MOLTEN METAL

BACKGROUND OF THE INVENTION

1. Field of the Invention

This invention relates generally to the feeding of molten metal in a casting apparatus. More specifically, this invention relates to the feeding of molten metal onto a flat planar area of a continuous moving casting surface such as a belt.

2. BACKGROUND INFORMATION

The metals industry has been developing processes and apparatus for producing an as-cast product that needs little or no additional processing such as hot rolling to reduce it to strip form. One such process that has arisen as a result of this development is the single belt casting process. In such a process, molten metal is caused to flow onto a moving horizontal surface in the form of a continuous belt whereupon it solidifies as it moves along with the belt. The elongated solid strip of metal is removed from the continuous belt for further processing as desired.

As attempts have been made to increase the speed of casting as measured in inches per minute of the cast strip, as well as to reduce the thickness of the cast alloys to eliminate further processing operations, several problems have arisen in connection with the feeding of the molten metal onto the belt due to the splashing and turbulence caused by the relative flow between the melt and the belt.

The belt must be maintained in a relatively cool condition in order to extract heat from the melt to cause the solidification thereof. Accordingly, the source of molten metal is usually spaced at some vertical distance from the belt to prevent it from heating the belt. When the molten metal is caused to flow directly from the source of the molten metal through the vertical distance into the belt, the melt will tend to splash as it hits the belt which may result in porosity in the cast product as well induce turbulence which can cause inclusions such as oxides. Additionally, there is the problem of achieving the spreading of the melt evenly across the width of the belt.

A typical approach undertaken in an attempt to solve these problems involves the use of a feeding means such as a tundish between the source of molten metal and the belt. Such feeding means normally takes the stream of molten metal issuing from the source and discharges it outwardly in the direction of movement of the belt. Although this approach solves the problem of splashing, the problems of proper spreading of the melt and dampening of its flow to reduce turbulence still remains.

The following references contain a discussion of various delivery systems used for the delivery of the melt to belt casters.

J. Herbertson, P. C. Campbell, A. G. Hunt and J. Freeman, "Strip Casting Studies at BHP Central Research Laboratories", *CCC'90 Fifth International Casting Conference,* Voest Alpine, Industrieanlangenbau, Linz, June, 1990; J. Herbertson and R. I. L. Guthrie, "A Novel Concept for Metal Delivery to Thin Strip Casters", *Casting of Near Net Shaped Products,* TMS-AIME, pp. 335–349; and J. S. Truelove, T. A. Gray, P. C. Campbell and J. Herbertson, "Fluid Dynamics in High-Speed Strip-Casting Metal Delivery System", *International Conference on New Smelting Reduction of Near Net Shape Casting Technologies for Steel,* SRNC-9, J. S. Truelove, pp. 1/10–11/10.

SUMMARY OF THE INVENTION

The present invention is directed to a feed system for supplying molten metal onto a planar moving surface which overcomes the problems mentioned above. In accordance with the present invention, an apparatus and process are provided for feeding molten metal onto a moving surface which includes a source of molten metal, a moving surface for receiving the molten metal, and feeding means located to receive molten metal from the source and deposit it onto the moving surface. The feeding means directs the metal onto said moving surface in a direction inclined toward the upstream side of the moving surface.

With the feed system of the present invention, the molten metal flows opposite to the direction of the moving surface so that the liquid fluid flow is immediately dampened and the dampening will spread the liquid melt to occupy a wider area on the moving surface. Moreover, a pool of liquid is formed on the moving surface slightly upstream of the flow of metal onto the surface which further dampens the fluid flow and helps the melt to match the belt velocity quickly.

BRIEF DESCRIPTION OF THE DRAWINGS

The present invention will be better understood by reference to the following detailed description and to the accompanying drawings in which.

DETAILED DESCRIPTION

Figure 1:
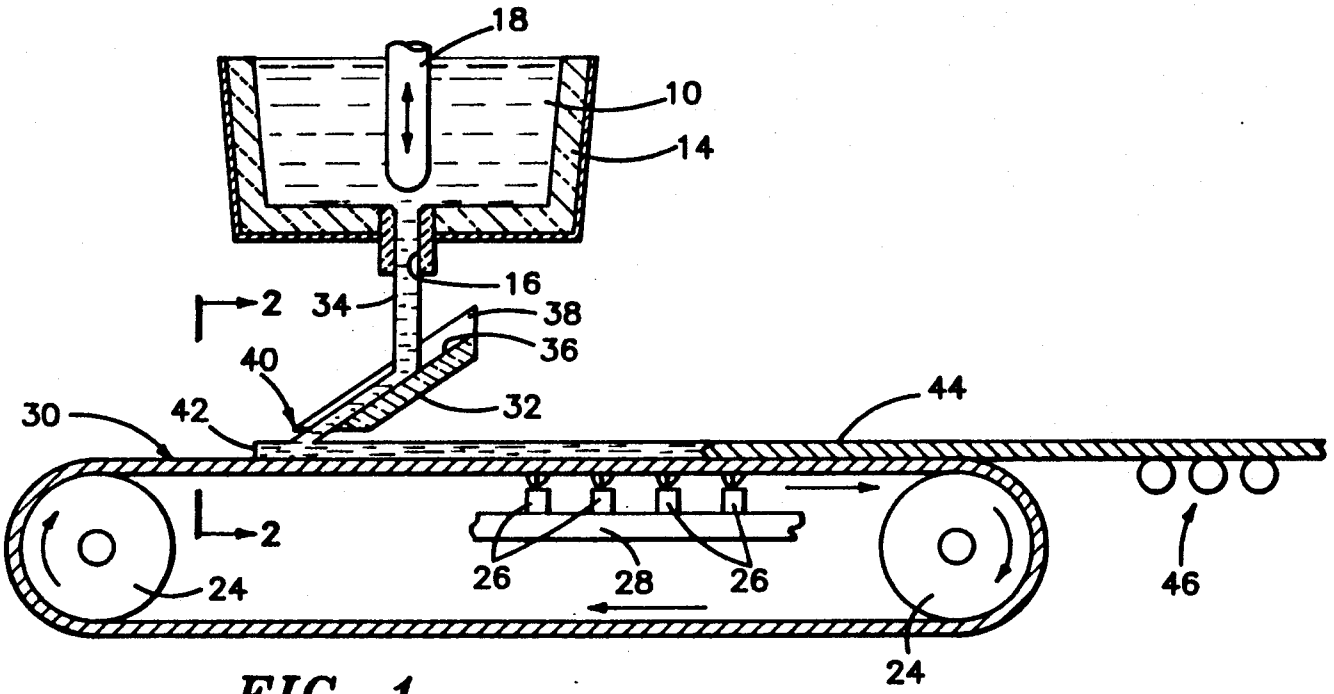
FIG. 1 is a schematic elevational view, partially in section, of casting apparatus incorporating the present invention.

Referring to the drawings, and in particular to FIG. 1, there is shown schematically a casting system of the continuous belt type which incorporates the present invention. The molten metal 10 may be supplied to the casting apparatus 12 from a refractory lined vessel 14 having a discharge opening 16 therein. A plunger 18 is provided in the interior of the vessel 14 which is associated with the discharge opening 16 to control the flow of molten metal from the vessel 14. For this purpose, the plunger 18 may be vertically reciprocated by any suitable mechanism (not shown).

A continuous belt arrangement 20 is mounted beneath the discharge opening 16 of the vessel 14. The belt arrangement 20 includes a continuous flexible belt 22 entrained about and extending between horizontally spaced rollers 24. One of the rollers 24 may be connected to a suitable drive means (not shown) to drive the belt 22 at the proper speed in the direction of the arrows shown in FIG. 1. The belt 22 may be made of any suitable material capable of withstanding the temperatures involved, but is preferably made of stainless steel or a high thermal conductivity material such as copper. Water jets 26 connected to a manifold 28 may be provided underneath the upper run 30 of the belt 22 to spray water against the underside of the belt for cooling purposes.

Feeding means such as a refractory lined tundish 32 is provided between the vessel 14 and the continuous belt arrangement 20 in a position to be contacted by the stream 34 of molten metal issuing from the outlet 16 of the vessel 14.

The tundish 32 may include a refractory lined trough-like member having a generally flat inclined bottom surface 36 with vertically extending side edges 38. As will be noted in FIG. 2, the width of the planar bottom surface 36 of the tundish 32 is less than the width of the belt 22. The tundish 32 is inclined as shown in FIG. 1 such that its flat or planar bottom surface 36 is inclined downwardly toward the upstream side of the upper view 30 of the continuous belt 22 such that its discharge end is pointing in a direction toward the upstream end and opposed to the direction of movement of the belt 22.

Figure 2:
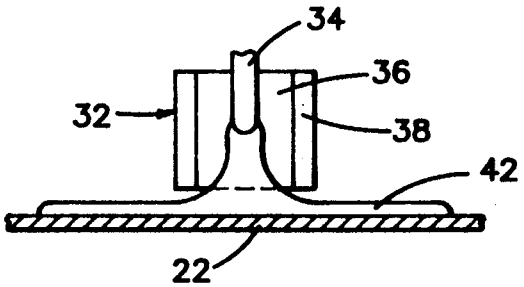
FIG. 2 is a sectional view taken along the lines 2—2 of FIG. 1.

With the arrangement of the tundish 32 as shown in the drawings, the molten metal stream 34 flows downwardly from the outlet orifice 16 of the vessel 14 and impacts against the bottom of the tundish 32. Any splashing is confined within the tundish 32. The molten metal stream 34 then flows down the inclined bottom surface 34 toward the upstream end of the upper run 30 of the continuous belt 22 in a direction opposed to the movement of the belt. Thus, the molten metal is flowing in a direction generally opposite to that of the movement of the belt when the molten metal impacts upon the belt. The extra metal flowing from the tundish 30 onto the belt forms a molten metal pool 42 slightly upstream of the discharge end 40 of the tundish 32. This metal serves to dampen the flowing metal behind it. Additionally, with the belt 22 moving in the opposite direction to the flow of the molten metal fed thereto, the molten metal pool 42 serves to immediately dampen the flowing metal and cause it to spread out across the width of the belt as shown in FIG. 2.

The molten metal is carried forward by the belt 22 wherein it is solidified into a continuous strip or thin slab 44. The strip 44 is separated from the belt 22 and may be either directly coiled or removed on a roller system 46 for further processing.

Experiments conducted using a moving steel substrate and a 60 percent tin - 40 percent lead melted alloy indicated that with such reverse flow as described above, dampening and spreading of the melt did occur in practice. While a tin-lead alloy was used for the experiments, this particular invention is thought particularly applicable to the casting of copper-based and iron-based alloys as well as aluminum alloys.

While the invention as described above shows the use of a continuous belt, the present invention is thought applicable to any movable substrate system in which a generally planar moving deposit area is presented for reception of the molten metal. For example, if only short lengths of the cast alloy as desired are needed, a flat movable table could be used in place of a continuous system.

While the invention has been described above with reference to a specific embodiment thereof, it is apparent that many changes, modifications and variations can be made without departing from the inventing concept disclosed. Accordingly, it is intended to embrace all such changes, modifications and variations that fall within the spirit and broad scope of the appended claims. All publications cited herein are incorporated by reference in their entirety.

What is claimed is:

1. An apparatus for feeding molten metal onto a moving surface in a casting apparatus comprising:

a source of molten metal;

a moving surface having a horizontal planar area thereon for receiving said molten metal;

feeding means located to receive said molten metal from said source and deposit it onto said moving surface, said feeding means directing said metal onto said moving surface in a direction toward the upstream end of the moving surface and opposed to the direction to movement of the moving surface; and cooling means located downstream of the point at which said metal is deposited on said moving surface for cooling said metal on said moving surface so said metal beginning to solidify at a point downstream of said point.

2. The apparatus of claim 1 wherein said feeding means comprises a tundish having a flat planar bottom surface, said flat planar bottom surface being inclined downwardly toward the upstream end of the moving surface.

3. The apparatus of claim 2 wherein said moving surface comprises an endless belt.

4. The apparatus of claim 3 wherein the width of said tundish is less then the width of said belt.

5. A process for casting molten metal into a solidified strip of material in which molten metal is fed onto a continuously moving surface having a generally planar area, said process comprising:

providing a source of molten metal;

providing a horizontal moving surface for receiving said molten metal and causing it to solidify thereon downstream of the point at which the molten metal is received on said moving surface; providing cooling means at a location downstream of said point; and feeding said molten metal from said source onto said moving surface in a direction toward the upstream end of the moving surface and opposed to the movement of the moving surface.

6. The process of claim 5 wherein said molten metal is fed onto a tundish having a bottom surface inclined downwardly in a direction toward the upstream end of said moving surface such that the molten metal flows onto said surface in a direction opposed to the direction of movement of said belt.

7. The process of claim 6 wherein said moving surface is a continuous belt.

* * * * *

UNITED STATES PATENT AND TRADEMARK OFFICE

CERTIFICATE OF CORRECTION

PATENT NO. : 5,148,855

DATED : September 22, 1992

INVENTOR(S) : S. Ashok

It is certified that error appears in the above—identified patent and that said Letters Patent is hereby corrected as shown below:

In column 4, line 17 delete "to" which is after "direction and before "movement.

Signed and Sealed this

Twenty-eighth Day of September, 1993

Bruce Lehman

*Attest:*

BRUCE LEHMAN

*Attesting Officer*

*Commissioner of Patents and Trademarks*